US010108117B2

(12) United States Patent
Shibuya

(10) Patent No.: US 10,108,117 B2
(45) Date of Patent: Oct. 23, 2018

(54) FIXING DEVICE, IMAGE FORMING APPARATUS COMPRISING FIXING DEVICE, METHOD FOR CONTROLLING FIXING DEVICE, AND COMPUTER-READABLE RECORDING MEDIUM WITH CONTROL PROGRAM FOR A FIXING DEVICE

(71) Applicant: Konica Minolta, Inc., Chiyoda-ku, Tokyo (JP)

(72) Inventor: Takuto Shibuya, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/433,453

(22) Filed: Feb. 15, 2017

(65) Prior Publication Data

US 2017/0235260 A1 Aug. 17, 2017

(30) Foreign Application Priority Data

Feb. 16, 2016 (JP) ..... 2016-026792

(51) Int. Cl.
*G03G 15/20* (2006.01)
*G03G 15/00* (2006.01)

(52) U.S. Cl.
CPC ..... *G03G 15/2053* (2013.01); *G03G 15/2064* (2013.01); *G03G 15/50* (2013.01)

(58) Field of Classification Search
CPC ..... G03G 15/2053
USPC ..... 399/45, 67, 328
See application file for complete search history.

(56) References Cited

U.S. PATENT DOCUMENTS 6,018,139 A * 1/2000 Matsuo ..... G03G 15/2053 219/216
2008/0138131 A1* 6/2008 Jung ..... G03G 15/2039 399/329
2016/0216664 A1* 7/2016 Yagi ..... G03G 15/2039

FOREIGN PATENT DOCUMENTS

JP 60149072 A * 8/1985 ..... G03G 15/2057
JP 2011123479 A 6/2011

* cited by examiner

*Primary Examiner* — Quana M Grainger
(74) *Attorney, Agent, or Firm* — Cantor Colburn LLP

(57) ABSTRACT

A fixing device includes: a fixing member; a pressurizing member provided in contact with the fixing member and configured to pressurize a sheet passing through a contact portion between the fixing member and the pressurizing member, against the fixing member; and a heater configured to heat the fixing member to provide heat to the sheet passing through the contact portion. The fixing member includes a heat storage material having a property that changes, by external energy, from a first solid phase to a second solid phase whose internal energy is higher than that of the first solid phase, and a property that changes from the second solid phase to the first solid phase by pressure and radiates heat during the phase change. The external energy includes thermal energy of the fixing member heated with the heater. The pressure includes a contact pressure between the fixing member and the pressurizing member.

24 Claims, 17 Drawing Sheets

FIG.17

124

| PHASE STATE | SOLID PHASE $\beta$ (WITHOUT HEAT STORAGE) | SOLID PHASE $\lambda$ (WITH HEAT STORAGE) |
|---|---|---|
| RADIUS OF FIXING ROLLER | $r_\beta$ | $r_\lambda (> r_\beta)$ |
| INTER-ROLLER DISTANCE | R | $R-(r_\lambda - r_\beta)$ |

FIXING DEVICE, IMAGE FORMING APPARATUS COMPRISING FIXING DEVICE, METHOD FOR CONTROLLING FIXING DEVICE, AND COMPUTER-READABLE RECORDING MEDIUM WITH CONTROL PROGRAM FOR A FIXING DEVICE

CROSS REFERENCE TO RELATED APPLICATIONS

This application is based on Japanese Patent Application No. 2016-026792 filed with the Japan Patent Office on Feb. 16, 2016, the entire content of which is hereby incorporated by reference.

BACKGROUND OF THE INVENTION

Field of the Invention

The present disclosure relates to control for an image forming apparatus, and particularly to control for a fixing device included in an electrophotographic image forming apparatus.

Description of the Related Art

An electrophotographic image forming apparatus becomes widespread. The electrophotographic image forming apparatus performs, as a printing process, a step of forming a toner image on a photosensitive body according to an input image, a step of primarily transferring the toner image on the photosensitive body to a transfer belt, a step of secondarily transferring the toner image on the transfer belt to a sheet, and a step of fixing the toner image to the sheet by heat using a fixing device.

The fixing device includes a fixing roller and a pressurizing roller. The fixing roller includes a heater. The heater heats the fixing roller. The pressurizing roller brings the sheet, which passes between the pressurizing roller and the fixing roller, into pressure contact with the fixing roller. Therefore, the sheet is pressurized and heated to fix the toner image onto the sheet.

In order to fix the toner image to the sheet, it is necessary for the fixing device to heat the sheet to a predetermined temperature or higher. For the purpose of energy saving, it is desirable to reduce energy necessary to heat the fixing device. As a technique for energy saving, for example, Japanese Laid-Open Patent Publication No. 2011-123479 discloses a fixing device in which, while the energy saving is achieved, a temperature drop of a heating roller due to paper feeding can be reduced and a neighborhood of a nip portion of the heating roller can rapidly be heated to a fixable temperature.

In the fixing device of Japanese Laid-Open Patent Publication No. 2011-123479, a heat storage material that changes between a liquid phase and a solid phase is used to achieve the energy saving. The heat storage material changes from the solid phase to the liquid phase after the printing, thereby absorbing heat. When a shock is given to the heat storage material at the beginning of the printing, the heat storage material changes from the liquid phase to the solid phase, whereby the heat storage material radiates the heat by the phase change. In the fixing device, the energy necessary to heat the fixing device is reduced using the heat radiation of the heat storage material. However, when a material that changes to the liquid phase is used as the heat storage material, a configuration preventing liquid leakage is required, which complicates a configuration of the fixing device.

SUMMARY OF THE INVENTION

The present disclosure has been made to solve the abovementioned disadvantage and an object of one aspect is to provide a fixing device that can achieve the energy saving with a simpler configuration. Another object of the present disclosure is to provide a method for controlling the fixing device that can achieve the energy saving with a simpler configuration. Still another object of the present disclosure is to provide a computer-readable recording medium in which a control program for the fixing device, which can achieve the energy saving with a simpler configuration, is stored.

To achieve at least one of the abovementioned objects, a fixing device, which fixes toner to a sheet by heat, reflecting one aspect of the present invention comprises: a fixing member; a pressurizing member provided in contact with the fixing member and configured to pressurize the sheet, which passes through a contact portion between the fixing member and the pressurizing member, against the fixing member; and a heating unit configured to heat at least one of the fixing member and the pressurizing member to provide heat to the sheet passing through the contact portion. At least one of the fixing member and the pressurizing member includes a heat storage material. The heat storage material has a property that changes from a first solid phase to a second solid phase by application of external energy, the second solid phase having internal energy higher than that of the first solid phase, and a property that changes from the second solid phase to the first solid phase by application of pressure and radiates heat during the phase change. The external energy applied for causing the heat storage material to change from the first solid phase to the second solid phase includes thermal energy of at least one of the fixing member and the pressurizing member, that is heated with the heating unit. The pressure applied for causing the heat storage material to change from the second solid phase to the first solid phase includes a contact pressure between the fixing member and the pressurizing member.

Preferably the fixing device does not cause the heat storage material to change from the first solid phase to the second solid phase during printing of the sheet.

Preferably the fixing device causes the heat storage material to change from the first solid phase to the second solid phase after printing of the sheet.

Preferably the external energy applied for causing the heat storage material to change from the first solid phase to the second solid phase includes residual heat of at least one of the fixing member and the pressurizing member after printing of the sheet.

Preferably the fixing device causes the heat storage material to change from the second solid phase to the first solid phase before printing of the sheet.

Preferably the heating unit performs, before printing of the sheet, warm-up to increase a temperature of the fixing member up to a first temperature at which the toner is able to be fixed to the sheet. The fixing device causes the heat storage material to change from the second solid phase to the first solid phase during the warm-up.

Preferably the heat storage material has a property that changes from the first solid phase to the second solid phase at a second temperature or higher. The second temperature is higher than the first temperature.

Preferably the fixing device causes the heat storage material to change from the second solid phase to the first solid phase during printing of the sheet.

Preferably the fixing device sets the contact pressure before printing of the sheet to be higher than the contact pressure during and after printing of the sheet.

Preferably the heat storage material is used in at least one of the fixing member and the pressurizing member, the fixing member and the pressurizing member constituting the contact portion.

Preferably the external energy applied for causing the heat storage material to change from the first solid phase to the second solid phase includes electric energy.

Preferably the fixing device further includes a thermoelectric element electrically connected to the heat storage material. The thermoelectric element converts the thermal energy into electric energy, and supplies the electric energy to the heat storage material as the external energy.

Preferably the fixing device changes a fixing condition during passage of the sheet through the contact portion, based on a volume change of the heat storage material due to the phase change of the heat storage material.

Preferably the fixing condition includes a pressurization load on the contact portion during passage of the sheet through the contact portion. The fixing device adjusts the pressurization load such that the contact pressure is kept constant in the contact portion, based on the volume change of the heat storage material.

Preferably the fixing condition includes a conveyance speed of the sheet during passage of the sheet through the contact portion. The fixing device enhances the conveyance speed of the sheet with increasing volume of the heat storage material.

According to another aspect of the present invention, an image forming apparatus includes the fixing device.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 17 is a view illustrating content of volume information.

DESCRIPTION OF THE PREFERRED EMBODIMENTS

Figure 1:
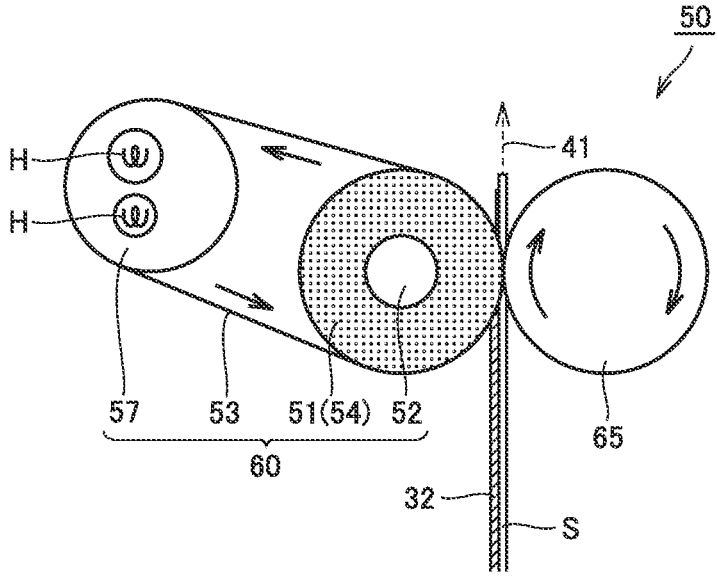
FIG. 1 is a view illustrating an internal structure of a fixing device according to a first embodiment.

Hereinafter, embodiments of the present invention will be described with reference to the accompanying drawings. In the following description, the same component is designated by the same reference numeral. The same holds true for the name and function. Accordingly, the overlapping description is omitted. The following embodiments and modifications may selectively be combined as appropriate.

First Embodiment

[Fixing Device 50]

An electrophotographic image forming apparatus 100 (see FIG. 11) performs, as a printing process, a step of forming a toner image on a photosensitive body, a step of performing primary transfer of the toner image on the photosensitive body to an intermediate transfer belt, a step of performing secondary transfer of the toner image on the intermediate transfer belt to a sheet, and a step of fixing the toner image to the sheet by heat. The step of fixing the toner image is performed with a fixing device 50 included in image forming apparatus 100.

Referring to FIG. 1, a step of fixing a toner image 32 with fixing device 50 will be described below. The printing process except for the fixing step will be described later. FIG. 1 is a view illustrating an internal structure of fixing device 50.

As illustrated in FIG. 1, fixing device 50 includes a fixing member 60 and a pressurizing roller 65. Fixing member 60 includes a fixing roller 51, a cored bar 52, a fixing belt 53, and a heating roller 57.

For example, heating roller 57 has a cylindrical shape. Heating roller 57 includes a heater H. Any number of heaters H may be used. For example, as illustrated in FIG. 1, heating roller 57 includes two heaters H. For example, heater H is a halogen heater.

Heater H (heating unit) heats fixing member 60 to provide heat to a sheet S that passes through a contact portion between fixing member 60 and pressurizing roller 65. More specifically, heater H heats heating roller 57 to transfer heat to fixing belt 53. Heated fixing belt 53 rotates to transfer the heat to fixing roller 51, and transfers the heat to sheet S conveyed on a conveyance path 41. The sheet S is heated to melt toner image 32 on sheet S. Resultantly, toner image 32 is fixed to sheet S. Heater H just needs to heat at least one of fixing member 60 and pressurizing roller 65. That is, an object to be heated by heater H may not be fixing member 60 but pressurizing roller 65. In this case, pressurizing roller 65 includes heater H.

Pressurizing roller 65 (pressurizing member) is provided in contact with fixing member 60. Pressurizing roller 65 pressurizes sheet S, which passes through the contact portion between pressurizing roller 65 and fixing member 60, against fixing member 60. Therefore, toner image 32 is pressurized on sheet S.

For example, fixing roller 51 has a cylindrical shape. Fixing roller 51 includes cored bar 52. Fixing roller 51 is made of a heat storage material 54. Fixing roller 51 may partially or wholly be made of heat storage material 54. Although an example in which fixing roller 51 is made of heat storage material 54 will be described below, fixing belt 53, heating roller 57, or pressurizing roller 65 may be made of heat storage material 54. That is, at least one of fixing member 60 and pressurizing roller 65 may include heat storage material 54.

Figure 2:
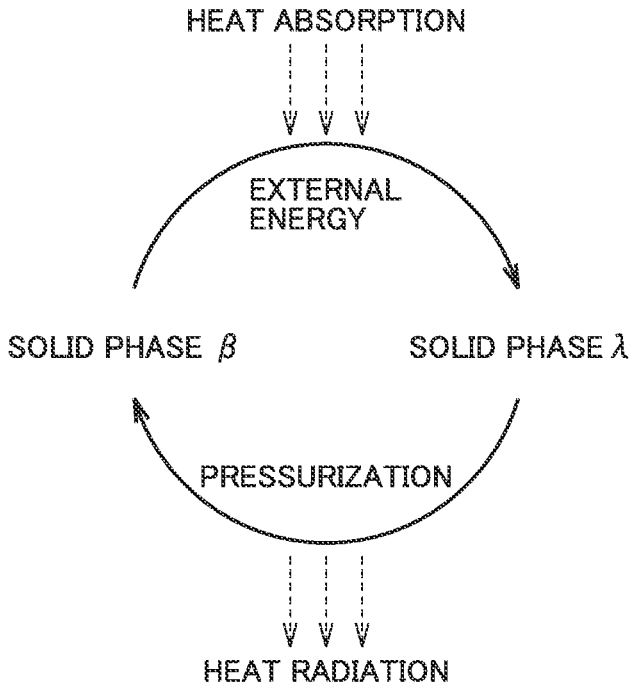
FIG. 2 is a view illustrating a mode of a phase change of a heat storage material.

Referring to FIG. 2, a property of heat storage material 54 will be described below. FIG. 2 is a view illustrating a mode of a phase change of heat storage material 54.

As illustrated in FIG. 2, heat storage material 54 has the property that changes from the solid phase β (first solid phase) to the solid phase λ (second solid phase) by application of external energy. The solid phase β differs from the solid phase λ in a crystal structure. Heat storage material 54 absorbs the heat when changing in phase from the solid phase β to the solid phase λ.. The external energy applied to the heat storage material 54 is stored in heat storage material 54 as latent heat. For example, the external energy applied for causing heat storage material 54 to change from the solid phase β to the solid phase λ includes thermal energy of at least one of fixing member 60 and pressurizing roller 65, which are heated with heater H.

Heat storage material 54 has the property, which changes from the solid phase λ to the solid phase β by application of the pressure and radiates the heat during the phase change. The pressure applied for causing heat storage material 54 to change from the solid phase λ to the solid phase β includes a contact pressure between fixing member 60 and pressurizing roller 65.

Thus, heat storage material 54 stores the heat of thermal energy from heater H. Then, heat storage material 54 radiates the stored thermal energy by the contact pressure between fixing member 60 and pressurizing roller 65, and uses the thermal energy in order to fix toner image 32 to sheet S. Therefore, in fixing device 50, the thermal energy necessary for the heating can be reduced to achieve the energy saving. Fixing device 50 stores and radiates the heat using the phase change between the solid phases. That is, because fixing device 50 does not use the phase change to a liquid phase for the purpose of the heat storage and heat radiation, it is not necessary to provide the configuration preventing the liquid leakage. Therefore, the configuration of fixing device 50 is simplified.

$Ti_3O_5$ (trititanium pentoxide) is used as an example of heat storage material 54. $Ti_3O_5$ changes in phase between β-$Ti_3O_5$ and λ-$Ti_3O_5$, which are stable at room temperature. β-$Ti_3O_5$ corresponds to solid phase β in FIG. 2. λ-$Ti_3O_5$ corresponds to solid phase λ in FIG. 2. β-$Ti_3O_5$ and λ-$Ti_3O_5$ each are a solid body. β-$Ti_3O_5$ has a property similar to that of semiconductor. λ-$Ti_3O_5$ has a property similar to that of metal.

When the temperature increases, β-$Ti_3O_5$ changes in phase to λ-$Ti_3O_5$ while involving an endothermic reaction (230 kJ/mol) at about 200° C. β-$Ti_3O_5$ has the property of a semiconductor, so that the phase change from β-$Ti_3O_5$ to λ-$Ti_3O_5$ can be generated by a method except for the heating. For example, β-$Ti_3O_5$ changes in phase to λ-$Ti_3O_5$ by current or light.

Even if a temperature of λ-$Ti_3O_5$ lowers to a room temperature, λ-$Ti_3O_5$ does not return to β-$Ti_3O_5$. λ-$Ti_3O_5$ changes in phase to β-$Ti_3O_5$ at pressure of 60 MPa or greater. That is, λ-$Ti_3O_5$ does not change in phase unless the pressure is applied. Therefore, λ-$Ti_3O_5$ can semipermanently store the thermal energy.

Heat storage material 54 is not limited to $Ti_3O_5$, but another material may be used as heat storage material 54. Any material having the property similar to that of $Ti_3O_5$ can be used as heat storage material 54.

[Phase Change Timing of Heat Storage Material 54]

As described above, heat storage material 54 changes between the solid phase β and the solid phase λ. For example, phase change timing of heat storage material 54 is controlled with a control device 101 (see FIG. 13) (to be described later).

Figure 3:
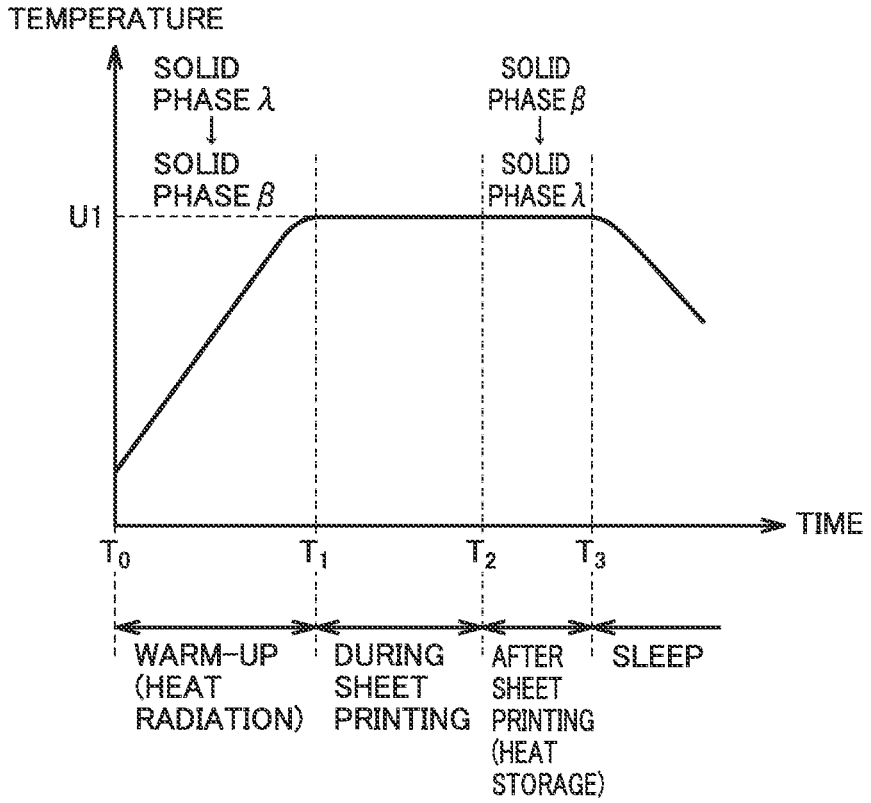
FIG. 3 is a view illustrating a temperature change, accompanied by printing processing, in a heat storage material.

Referring to FIG. 3, the phase change timing of heat storage material 54 with control device 101 will be described below. FIG. 3 is a view illustrating a temperature change, accompanied by the printing processing, in heat storage material 54.

It is assumed that image forming apparatus 100 (see FIG. 11) receives a printing instruction from a user at a time $T_0$. Therefore, fixing device 50 starts warm-up processing. As used herein, the warm-up means pre-processing that is performed before the printing. Through the warm-up processing, heater H (see FIG. 1) heats fixing member 60 (see FIG. 1) up to a temperature (first temperature) at which the toner image can be fixed to the sheet. Hereinafter the temperature is also referred to as a "target temperature U1". Heat storage material 54 is heated by heating fixing member 60. Heater H performs the warm-up processing from time $T_0$ to a time $T_1$.

Fixing device 50 causes heat storage material 54 to change from the solid phase λ to the solid phase β before sheet printing. As used herein, the term "before the sheet printing" means time before the sheet passes through the contact portion between fixing member 60 and pressurizing roller 65. Although a method for causing heat storage material 54 to change from the solid phase λ to the solid phase β will be described later, fixing device 50 pressurizes fixing member 60 between time $T_0$ and time Ti to cause heat storage material 54 to change from the solid phase λ to the solid phase β.

Preferably fixing device 50 causes heat storage material 54 to change from the solid phase λ to the solid phase β before the warm-up. During the warm-up, fixing device 50 can rapidly heat fixing device 50 up to target temperature U1 using the heat radiation accompanied by the phase change from the solid phase λ to the solid phase β. Resultantly, electric power necessary for the warm-up processing is reduced to achieve the energy saving.

The timing of causing heat storage material 54 to change from the solid phase β to the solid phase λ is not limited to the warm-up time. For example, fixing device 50 may cause heat storage material 54 to change from the solid phase β to the solid phase λ during the sheet printing. As used herein, the term "during the sheet printing" means time during which the sheet passes through the contact portion between fixing member 60 and pressurizing roller 65.

It is assumed that fixing device 50 is heated up to target temperature U1 at time $T_1$. When the fixing device 50 is heated up to target temperature U1, image forming apparatus 100 starts the printing to sequentially convey a printing target sheet to fixing device 50. Preferably fixing device 50 does not cause heat storage material 54 to change from the solid phase β to the solid phase λ during the sheet printing. Therefore, because heat storage material 54 does not absorb the heat during the printing, the heat generated from heater H is efficiently transferred to the sheet.

It is assumed that printing processing is ended at a time $T_2$. Fixing device 50 causes heat storage material 54 to change from the solid phase β to the solid phase λ after the sheet printing. As used herein, the term "after the sheet printing" means time after the sheet passes through the contact portion between fixing member 60 and pressurizing roller 65. Fixing device 50 provides the external energy to heat storage material 54 between a time $T_2$ and a time T3 after the sheet printing. At this point, the external energy applied to heat storage material 54 is electric energy, for example. A method for supplying electric energy will be described later. Internal energy of heat storage material 54 increases by application of the electric energy after the sheet printing, and heat storage material 54 changes from the solid phase β to the solid phase λ. Thus, heat storage material 54 stores the thermal energy from heater H or the electric energy to produce the phase change, and stores the heat in preparation for the next printing. Fixing device 50 may not provide the electric energy but the thermal energy to heat storage material 54, and cause heat storage material 54 to change from the solid phase β to the solid phase λ. Fixing device 50 may irradiate heat storage material 54 with light instead of providing the electric energy, and cause heat storage material 54 to change from the solid phase β to the solid phase λ.

Preferably the external energy applied for causing heat storage material 54 to change from the solid phase β to the solid phase λ includes residual heat of at least one of fixing member 60 and pressurizing roller 65 after the sheet printing. In heat storage material 54, the energy saving can be achieved using the residual heat.

It is assumed that, at time T3, image forming apparatus 100 (see FIG. 11) makes a transition to a sleep state in which a low-power state is maintained. The temperature of heat storage material 54 lowers. Heat storage material 54 does not return from the solid phase λ to the solid phase β by this temperature change. Therefore, heat storage material 54 can maintain the heat storage state until the next printing processing.

[Method for Producing Phase Change from Solid Phase β to Solid Phase λ ]

Figure 4:
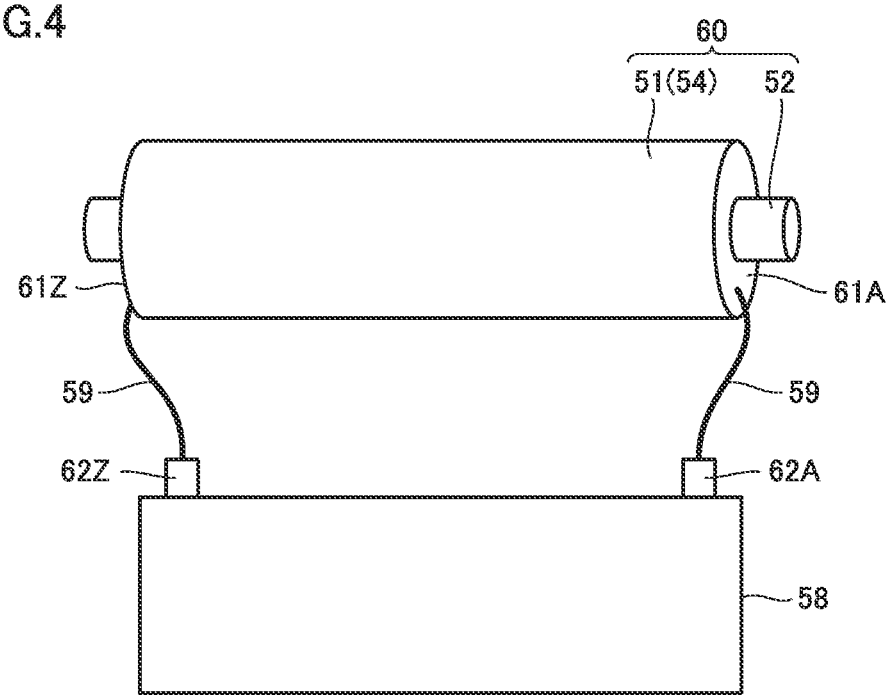
FIG. 4 is a view illustrating an example of a configuration that causes the heat storage material to change from a solid phase β to a solid phase λ.
Figure 5:
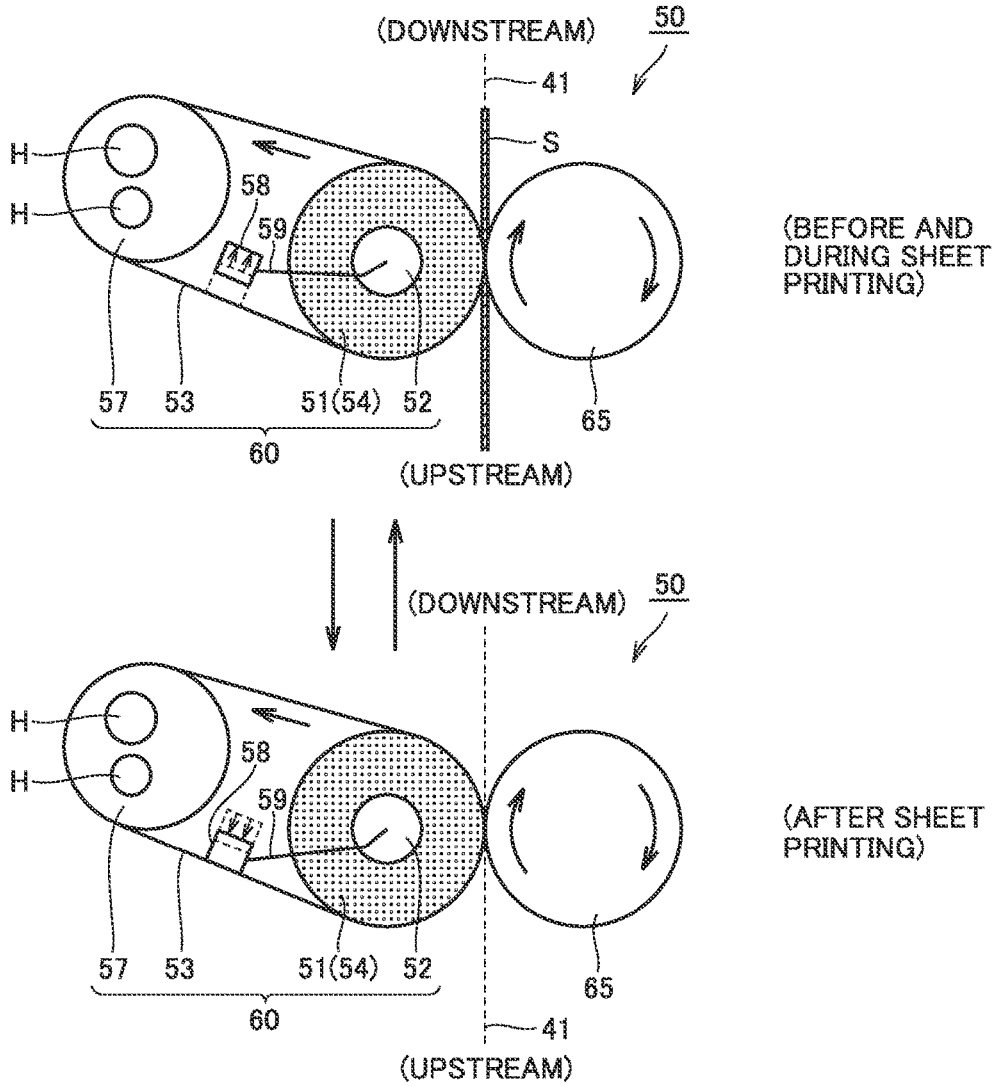
FIG. 5 is a view illustrating a mode of a thermoelectric element before and during printing and a mode of the thermoelectric element after the printing.

As described above, fixing device 50 causes heat storage material 54 to change from the solid phase β to the solid phase λ after the sheet printing, and causes heat storage material 54 to store the heat. Referring to FIGS. 4 and 5, the method for causing heat storage material 54 to change from the solid phase β to the solid phase λ will be described below. FIG. 4 is a view illustrating an example of a configuration that causes the heat storage material 54 to change from the solid phase β to the solid phase λ.

As illustrated in FIG. 4, fixing roller 51 has, at one end, an electrode 61A, and at the other end, an electrode 61Z. Electrodes 61A and 61Z are connected with one ends of leads 59. The other ends of leads 59 are connected with electrodes 62A and 62Z of thermoelectric element 58. That is, thermoelectric element 58 is electrically connected to heat storage material 54.

Thermoelectric element 58 converts the thermal energy into the electric energy using the Seebeck effect. When a temperature difference is generated between both surfaces of thermoelectric element 58, a potential difference is generated between the surfaces of thermoelectric element 58 according to the temperature difference. Resultantly, the current flows in heat storage material 54 through leads 59. Using this phenomenon, fixing device 50 causes heat storage material 54 to change from the solid phase β to the solid phase λ.

FIG. 5 is a view illustrating a mode of thermoelectric element 58 before and during printing and a mode of thermoelectric element 58 after the printing. As illustrated in FIG. 5, thermoelectric element 58 is provided inside fixing belt 53. In fixing device 50, thermoelectric element 58 is not brought into contact with fixing belt 53 before and during the sheet printing. At this point, because the temperature difference is not generated between the surfaces of thermoelectric element 58, the electric energy is not supplied to heat storage material 54. Therefore, heat storage material 54 does not change from the solid phase β to the solid phase λ before and during the sheet printing.

In fixing device 50, thermoelectric element 58 is brought into contact with an inner surface of fixing belt 53 after the sheet printing. Because fixing belt 53 is heated with heater H immediately after the sheet printing, the temperature difference is generated between the surfaces of thermoelectric element 58. Resultantly, the potential difference is generated between the surfaces of thermoelectric element 58, and the current flows in heat storage material 54 through cored bar 52. Therefore, the internal energy of heat storage material 54 increases, and heat storage material 54 changes from the solid phase β to the solid phase λ. The external energy applied for causing heat storage material 54 to change from the solid phase β to the solid phase λ includes the electric energy.

Thermoelectric element 58 converts the thermal energy obtained from fixing belt 53 into the electric energy, and supplies the electric energy to heat storage material 54 as the external energy. Not only the thermal energy but also the electric energy is applied to heat storage material 54, thereby causing heat storage material 54 to change more surely from the solid phase β to the solid phase λ.

[Method for Driving Thermoelectric Element 58]

Figure 6:
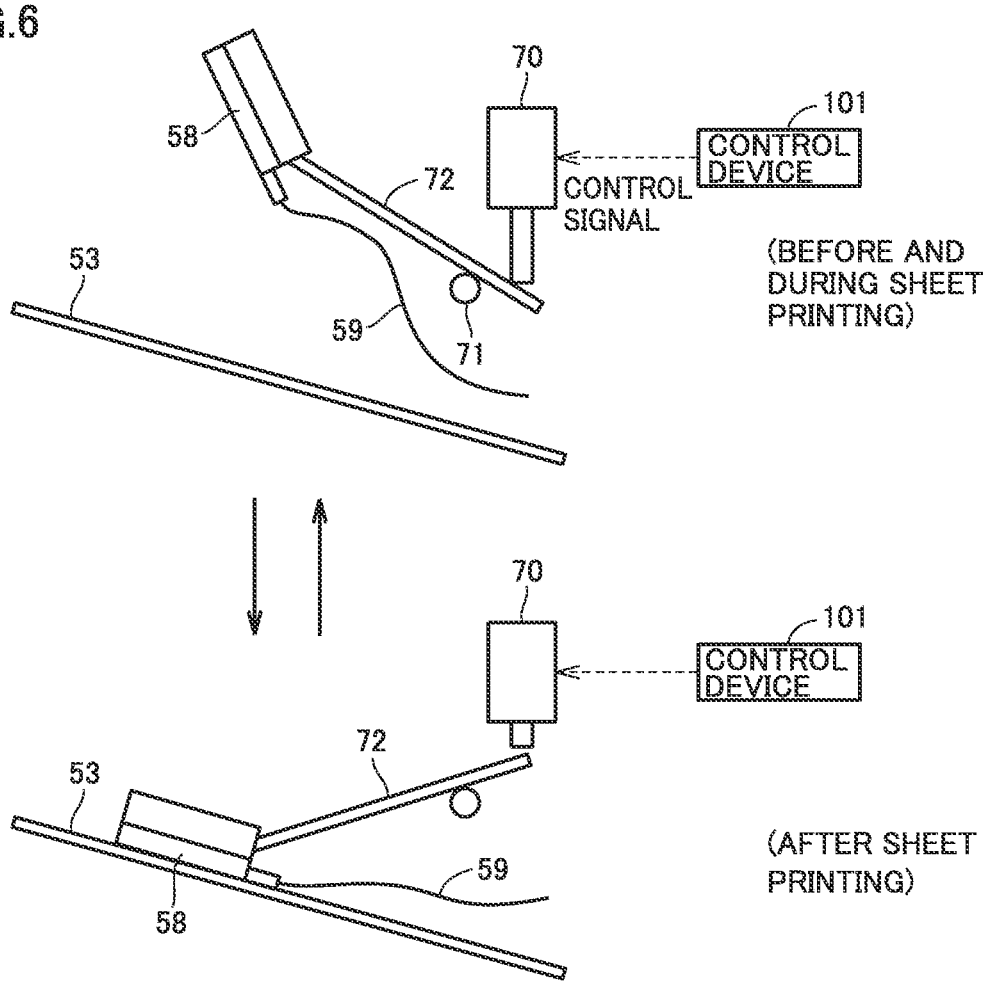
FIG. 6 is a view illustrating an example of a driving structure of a thermoelectric element.

Referring to FIG. 6, an example of a method for driving thermoelectric element 58 will be described below. FIG. 6 is a view illustrating an example of a driving structure of thermoelectric element 58.

As illustrated in FIG. 6, for example, heat storage material 54 is driven using a switch 70. Switch 70 is a switch element such as a solenoid. Switch 70 is driven according to a control signal from control device 101.

A metal plate 72 is supported at a support point 71. One end of metal plate 72 adheres to one surface of thermoelectric element 58. The other end of metal plate 72 is pressed by switch 70. When being pressed by switch 70, metal plate 72 lifts thermoelectric element 58 about support point 71. Therefore, switch 70 separates thermoelectric element 58 from fixing belt 53.

Before and during the sheet printing, control device 101 causes switch 70 to separate thermoelectric element 58 from fixing belt 53. At this point, because the temperature difference is not generated between the surfaces of thermoelectric element 58, electromotive force is not generated in thermoelectric element 58.

After the sheet printing, control device 101 causes switch 70 to bring thermoelectric element 58 into contact with fixing belt 53. When thermoelectric element 58 comes into contact with high-temperature fixing belt 53, the temperature difference is generated between the surfaces of thermoelectric element 58, and the electromotive force is generated in thermoelectric element 58. Therefore, the electric energy is applied to heat storage material 54, and heat storage material 54 changes from the solid phase β to the solid phase λ.

The unit for driving thermoelectric element 58 is not limited to switch 70. For example, a driving mechanism such as a cam may be used instead of switch 70.

[Internal Structure of Thermoelectric Element 58]

Figure 7:
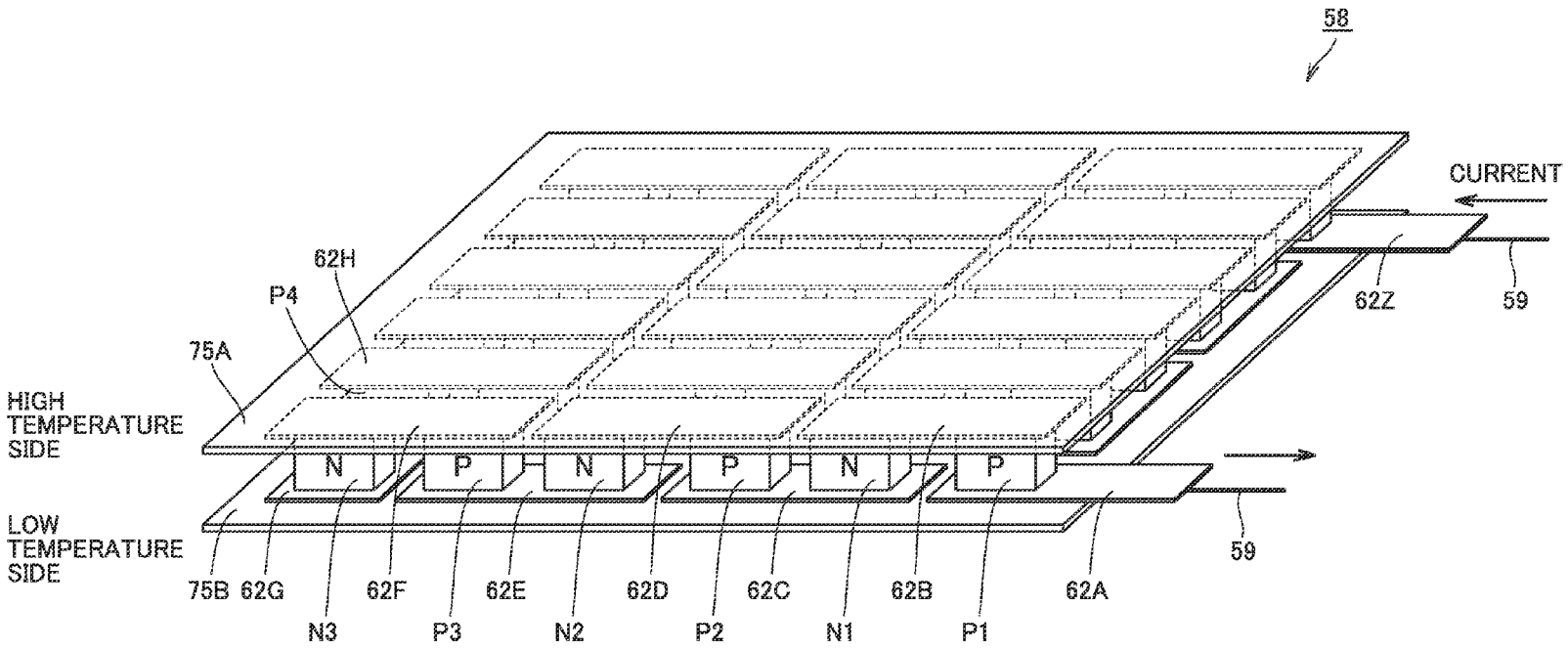
FIG. 7 is a view illustrating an example of an internal structure of the thermoelectric element.

Referring to FIG. 7, an internal structure of thermoelectric element 58 in FIGS. 4 to 6 will be described below. FIG. 7 is a view illustrating an example of the internal structure of thermoelectric element 58.

As illustrated in FIG. 7, thermoelectric element 58 is formed into a sheet shape. Thermoelectric element 58 includes insulating substrates 75A and 75B. A plurality of N-type semiconductors, a plurality of P-type semiconductors, and a plurality of electrodes are provided between insulating substrates 75A and 75B. Each N-type semiconductor and each P-type semiconductor are connected in series to each other by each electrode. The electrode provided on the side of insulating substrate 75A is disposed in a high-temperature space compared with the electrode provided on the side of insulating substrate 75B. Thermoelectric element 58 generates the electromotive force according to the temperature difference between the electrode provided on the side of insulating substrate 75A and the electrode provided on the side of insulating substrate 75B.

More specifically, one surface of a P-type semiconductor P1 is connected to an electrode 62A. The other surface of P-type semiconductor P1 is connected to an electrode 62B. One surface of an N-type semiconductor N1 is connected to electrode 62B. The other surface of N-type semiconductor N1 is connected to an electrode 62C. One surface of a P-type semiconductor P2 is connected to electrode 62C. The other surface of P-type semiconductor P2 is connected to an electrode 62D. One surface of an N-type semiconductor N2 is connected to electrode 62D. The other surface of N-type semiconductor N2 is connected to an electrode 62E. One surface of a P-type semiconductor P3 is connected to electrode 62E. The other surface of P-type semiconductor P3 is connected to an electrode 62F. One surface of an N-type semiconductor N3 is connected to electrode 62F. The other surface of N-type semiconductor N3 is connected to an electrode 62G. One surface of a P-type semiconductor P4 is connected to electrode 62G. The other surface of P-type semiconductor P4 is connected to an electrode 62H. Similarly, the P-type semiconductor and the N-type semiconductor are connected in series to each other up to an electrode 62Z.

FIG. 7 illustrates an example in which thermoelectric element 58 is constructed with the plurality of P-type semiconductors and the plurality of N-type semiconductors. Alternatively, thermoelectric element 58 may be constructed with one P-type semiconductor and one N-type semiconductor.

[Method for Producing Phase Change from Solid Phase λ to Solid Phase β]

As described above, before the sheet printing, fixing device 50 pressurizes heat storage material 54, thereby causing heat storage material 54 to change from the solid phase λ to the solid phase β. Therefore, heat storage material 54 radiates the heat to increase the temperature of fixing device 50.

Figure 8:
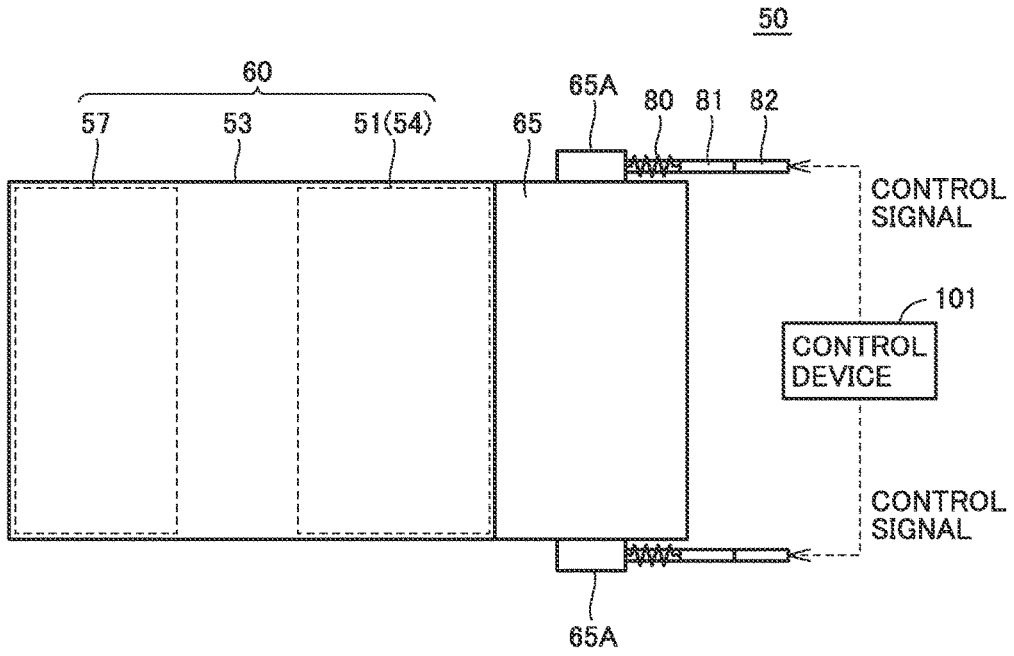
FIG. 8 is a view illustrating an example of a configuration that causes the heat storage material to change from the solid phase λ to the solid phase β.
Figure 9:
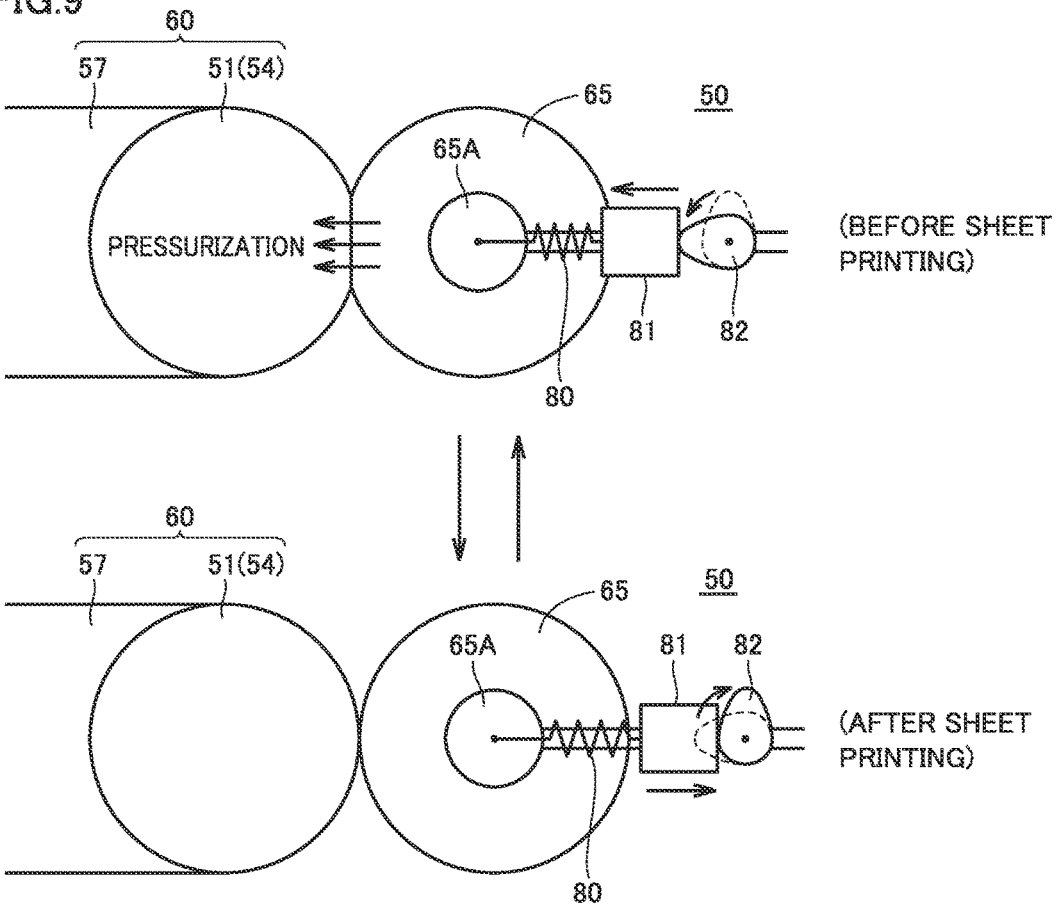
FIG. 9 is a view illustrating a mode of a pressure roller before the printing of a sheet and a mode of the pressurizing roller after the printing of the sheet.

Referring to FIGS. 8 and 9, the method for causing heat storage material 54 to change from the solid phase λ to the solid phase β will be described below. FIG. 8 is a view illustrating an example of a configuration that causes heat storage material 54 to change from the solid phase λ to the solid phase β. FIG. 9 is a view illustrating a mode of pressurizing roller 65 before the printing of a sheet and a mode of pressurizing roller 65 after the printing of the sheet.

As illustrated in FIGS. 8 and 9, control device 101 rotates a cam 82 to change the contact pressure between fixing member 60 and pressurizing roller 65. For example, cam 82 is driven by a motor (not illustrated). Control device 101 controls the motor to control the rotation of cam 82.

A rotating shaft 65A of pressurizing roller 65 is connected to one end of a spring 80. The other end of spring 80 is connected to a slide mechanism 81. Slide mechanism 81 slides in a crosswise direction according to a rotation direction of cam 82. When cam 82 rotates such that a long-axis direction of cam 82 turns to pressurizing roller 65, cam 82 presses slide mechanism 81. Resultantly, spring 80 is compressed, and rotating shaft 65A is pressed onto the side of fixing member 60 to increase the contact pressure between fixing member 60 and pressurizing roller 65. When cam 82 rotates such that a short-axis direction of cam 82 turns to pressurizing roller 65, spring 80 extends. Resultantly, the contact pressure between fixing member 60 and pressurizing roller 65 decreases.

In fixing device 50, the contact pressure between fixing member 60 and pressurizing roller 65 before the sheet printing is set larger than the contact pressure between fixing member 60 and pressurizing roller 65 after the sheet printing. More specifically, fixing device 50 rotates the long-axis direction of cam 82 onto the side of pressurizing roller 65 before the sheet printing. Therefore, the contact pressure between fixing member 60 and pressurizing roller 65 increases, and fixing device 50 causes heat storage material 54 to change from the solid phase λ to the solid phase β. Resultantly, heat storage material 54 radiates the heat to increase the temperature in the contact portion between fixing member 60 and pressurizing roller 65. Preferably the contact pressure between fixing member 60 and pressurizing roller 65 is greater than or equal to 60 MPa before the sheet printing.

In fixing device 50, the contact pressure between fixing member 60 and pressurizing roller 65 after the sheet printing is set smaller than the contact pressure between fixing member 60 and pressurizing roller 65 before the sheet printing. More specifically, fixing device 50 rotates the short-axis direction of cam 82 onto the side of pressurizing roller 65 after the sheet printing. Therefore, fixing device 50 decreases the contact pressure between fixing member 60 and pressurizing roller 65 to prevent heat storage material 54 from changing from the solid phase λ to the solid phase β after the sheet printing. Preferably the contact pressure between fixing member 60 and pressurizing roller 65 is smaller than 60 MPa after the sheet printing.

Preferably heat storage material 54 is used in at least one of fixing member 60 and pressurizing roller 65, which constitute the contact portion. Therefore, because the pressure is directly transferred from pressurizing roller 65 to heat storage material 54, the phase change from the solid phase λ to the solid phase β is more surely generated. [Target temperature of fixing device 50]

As described above, fixing device 50 performs the warm-up processing as the pre-processing of the printing processing. Through the warm-up processing, fixing member 60 is heated up to target temperature U1 at which the toner image can be fixed to the sheet.

Figure 10:
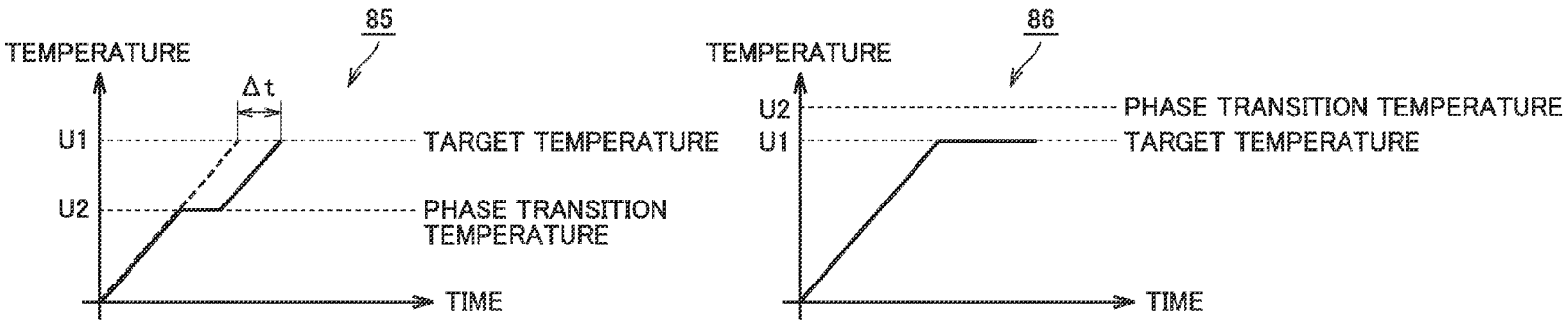
FIG. 10 is a view illustrating a temporal change in temperature of a fixing member.

Referring to FIG. 10, target temperature U1 will be described below. FIG. 10 is a view illustrating a temporal change in temperature of fixing member 60.

Heat storage material 54 has a property that changes from the solid phase β to the solid phase λ at a phase transition temperature U2 or higher. As illustrated in a graph 85, when phase transition temperature U2 is lower than target temperature U1, the phase change from the solid phase β to the solid phase λ is generated while the temperature of fixing device 50 is heated up to target temperature U1. Resultantly, the endothermic reaction is generated in heat storage material 54, and time at which fixing device 50 reaches target temperature U1 is delayed by Δt.

Therefore, as illustrated in a graph 86, preferably phase transition temperature U2 is higher than target temperature U1. The use of heat storage material 54 in which phase transition temperature U2 is higher than target temperature U1 does not generate the endothermic reaction of heat storage material 54 while the temperature of fixing device 50 is increased, so that the temperature of fixing device 50 can efficiently be increased.

As described above, heat storage material 54 having phase transition temperature U2 higher than target temperature U1 is used by way of example. Alternatively, target temperature U1 may be adjusted. That is, unless a relative temperature relationship that phase transition temperature U2 is higher than target temperature U1 is changed, either phase transition temperature U2 or target temperature U1 may be adjusted.

[Internal Structure of Image Forming Apparatus 100]

Figure 11:
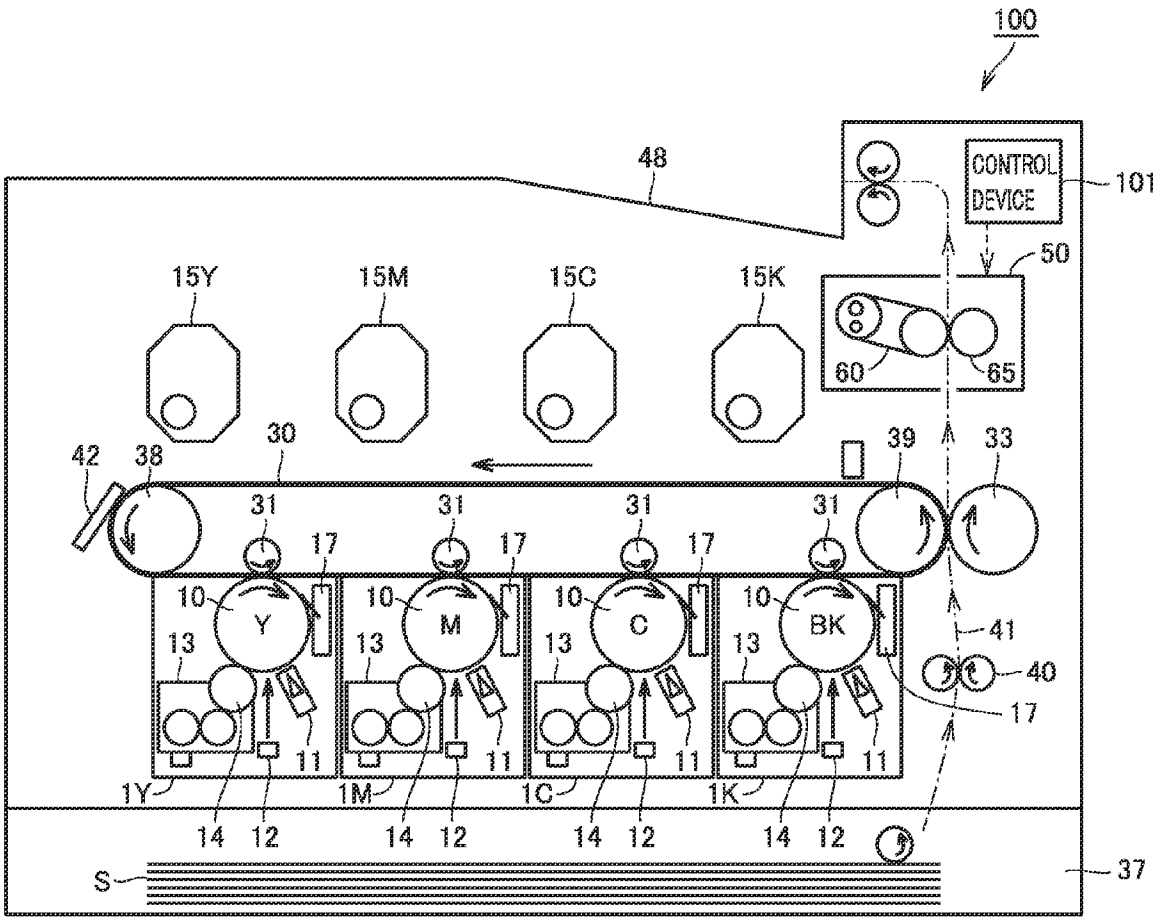
FIG. 11 is a view illustrating an example of an internal structure of the image forming apparatus.

Referring to FIG. 11, image forming apparatus 100 on which fixing device 50 is mounted will be described below. FIG. 11 is a view illustrating an example of an internal structure of image forming apparatus 100.

FIG. 11 illustrates image forming apparatus 100 as a color printer. Although image forming apparatus 100 as the color printer will be described below, image forming apparatus 100 is not limited to the color printer. For example, image forming apparatus 100 may be a monochrome printer, a facsimile machine, a monochrome printer, or a multi-functional peripheral (MFP) in which the color printer and the facsimile machine are combined.

Image forming apparatus 100 includes image forming units 1Y, 1M, 1C, and 1K, an intermediate transfer belt 30, a primary transfer roller 31, a secondary transfer roller 33, a cassette 37, a driven roller 38, a driving roller 39, a timing roller 40, a cleaning blade 42, fixing device 50, and control device 101.

Image forming unit 1Y receives supply of toner from a toner bottle 15Y to form a yellow (Y) toner image. Image forming unit 1M receives supply of toner from a toner bottle 15M to form a magenta (M) toner image. Image forming unit 1C receives supply of toner from a toner bottle 15C to form a cyan (C) toner image. Image forming unit 1K receives supply of toner from a toner bottle 15K to form a black (BK) toner image.

Image forming units 1Y, 1M, 1C, and 1K are sequentially disposed in a rotation direction of intermediate transfer belt 30 along intermediate transfer belt 30. Each of image forming units 1Y, 1M, 1C, and 1K includes a photosensitive body 10, a charger 11, an exposure unit 12, a development unit 13, and a cleaning blade 17.

Charger 11 uniformly charges a surface of photosensitive body 10. Exposure unit 12 irradiates photosensitive body 10 with a laser beam according to the control signal from control device 101, and exposes the surface of photosensitive body 10 according to an input image pattern. Therefore, an electrostatic latent image is formed on photosensitive body 10 according to an input image.

Development unit 13 applies a development bias to a development roller 14 while rotating development roller 14, and causes the toner to adhere to the surface of development roller 14. Therefore, the toner is transferred from development roller 14 to photosensitive body 10, and the toner image is developed on the surface of photosensitive body 10 according to the electrostatic latent image.

Photosensitive body 10 and intermediate transfer belt 30 are in contact with each other in a portion in which primary transfer roller 31 is provided. Primary transfer roller 31 having a roller shape is configured to be rotatable. A transfer voltage having an opposite polarity to the toner image is applied to primary transfer roller 31, whereby the toner image is transferred from photosensitive body 10 to intermediate transfer belt 30. The yellow (Y) toner image, the magenta (M) toner image, the cyan (C) toner image, and the black (BK) toner image sequentially overlapped one another, and transferred from photosensitive body 10 to intermediate transfer belt 30. Therefore, a color toner image is formed on intermediate transfer belt 30.

Intermediate transfer belt 30 is entrained about driven roller 38 and driving roller 39. Driving roller 39 is connected to a motor (not illustrated). For example, the motor is controlled with control device 101. For example, pulse width modulation (PWM) control is adopted as a method for controlling the motor. Control device 101 controls the motor, thereby rotating driving roller 39. Intermediate transfer belt 30 and driven roller 38 rotate in conjunction with driving roller 39. Therefore, the toner image on intermediate transfer belt 30 is conveyed to secondary transfer roller 33.

Cleaning blade 17 is brought into press contact with photosensitive body 10. Cleaning blade 17 recovers the toner remaining on the surface of photosensitive body 10 after the toner image is transferred from photosensitive body 10 to intermediate transfer belt 30.

Sheets S are set in cassette 37. Timing roller 40 feeds sheets S one by one from cassette 37 to secondary transfer roller 33 along conveyance path 41. Control device 101 controls the transfer voltage applied to secondary transfer roller 33 in synchronization with timing of feeding sheet S.

Secondary transfer roller 33 having a roller shape is configured to be rotatable. Secondary transfer roller 33 applies the transfer voltage having the opposite polarity to the toner image to currently-conveyed sheet S. Therefore, the toner image is attracted from intermediate transfer belt 30 to secondary transfer roller 33 to transfer the toner image on intermediate transfer belt 30. The timing of conveying sheet S to secondary transfer roller 33 is controlled with timing roller 40 according to a position of the toner image on intermediate transfer belt 30. Resultantly, the toner image on intermediate transfer belt 30 is transferred to a proper position of sheet S.

Fixing device 50 includes fixing member 60 and pressurizing roller 65. Fixing device 50 pressurizes and heats sheet S that passes between fixing member 60 and pressurizing roller 65. In response to the control signal from control device 101, fixing device 50 controls a heating degree of fixing member 60 and the contact pressure between fixing member 60 and pressurizing roller 65. Fixing device 50 pressurizes and heats sheet S to fix the toner image to sheet S. Then sheet S is discharged to a tray 48.

Cleaning blade 42 is brought into press contact with intermediate transfer belt 30. Cleaning blade 42 recovers the toner remaining on the surface of intermediate transfer belt 30 after the toner image is transferred from intermediate transfer belt 30 to sheet S. The recovered toner is conveyed with a conveying screw (not illustrated), and stored in a waste toner container (not illustrated).

[Control Structure of Image Forming Apparatus 100]

Figure 12:
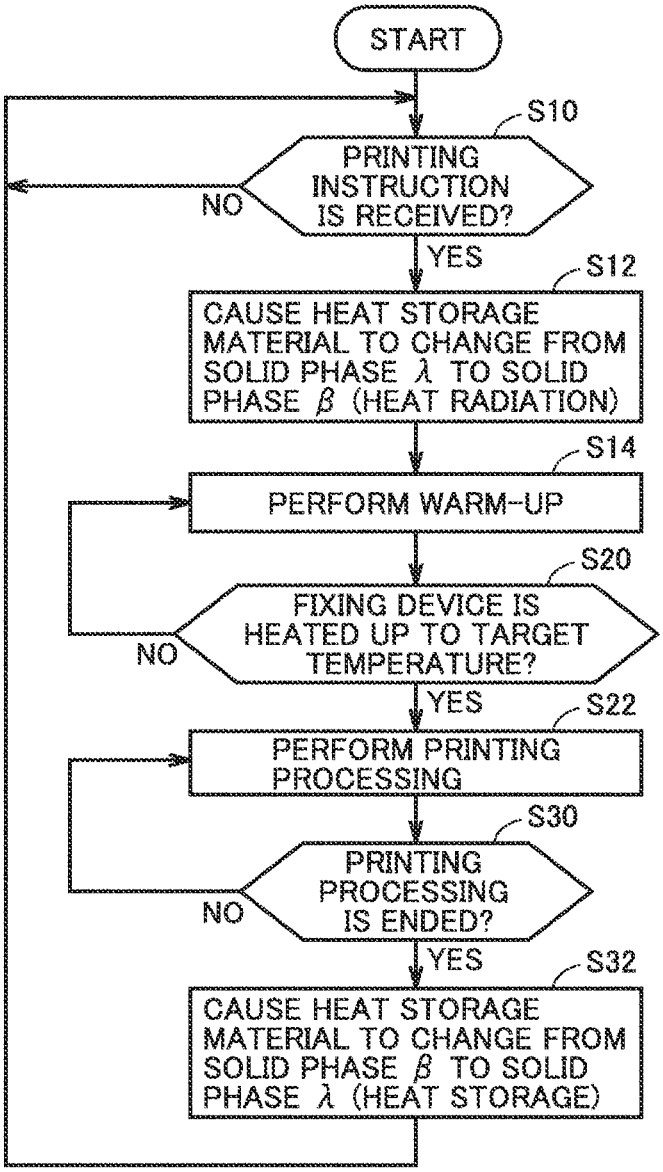
FIG. 12 is a flowchart partially illustrating processing performed with the image forming apparatus.

Referring to FIG. 12, a control structure of image forming apparatus 100 will be described below. FIG. 12 is a flowchart partially illustrating processing performed with image forming apparatus 100. Control device 101 executes a program to perform the processing in FIG. 12. In another aspect, a part or whole of the processing may be performed with a circuit element or hardware except for the circuit element.

In step S10, control device 101 determines whether a printing instruction is received. When determining that the printing instruction is received (YES in step S10), control device 101 switches the control to step S12. When determining that the printing instruction is not received (NO in step S10), control device 101 performs the processing in step S10 again.

In step S12, control device 101 applies the contact pressure between fixing member 60 (see FIG. 1) and pressurizing roller 65 (see FIG. 1) to heat storage material 54 (see FIG. 1), and causes heat storage material 54 to change from the solid phase λ to the solid phase β. Heat storage material 54 radiates the heat by the phase change to increase the temperature of fixing device 50. The processing in step S12 may be performed before or during the warm-up processing in step S14.

In step S14, control device 101 performs the warm-up processing on fixing device 50 as the pre-processing of the printing processing. That is, control device 101 performs processing of heating fixing member 60. A heating target may be pressurizing roller 65. That is, control device 101 may heat at least one of fixing member 60 and pressurizing roller 65.

In step S20, control device 101 determines whether fixing device 50 is heated up to a target temperature. When determining that fixing device 50 is heated up to the target temperature (YES in step S20), control device 101 switches the control to step S22. When determining that fixing device 50 is not heated up to the target temperature (NO in step S20), control device 101 returns the processing to step S14.

In step S22, control device 101 starts the printing processing. Therefore, the sheets are sequentially conveyed to fixing device 50.

In step S30, control device 101 determines whether all the sheets are printed according to the received printing instruction. When determining that all the sheets are printed according to the received printing instruction (YES in step S30), control device 101 switches the control to step S32. When determining that all the sheets are not printed according to the received printing instruction (NO in step S30), control device 101 returns the processing to step S22.

In step S32, control device 101 applies the thermal energy of at least one of fixing member 60 and pressurizing roller 65, which are heated with heater H (see FIG. 1), to heat storage material 54 as the external energy for the phase change, and causes heat storage material 54 to change from the solid phase β to the solid phase λ. Heat storage material 54 stores the heat by the phase change. Preferably the electric energy is further applied to heat storage material 54 as the external energy applied for causing heat storage material 54 to change from the solid phase β to the solid phase λ. The thermal energy stored in heat storage material 54 is used in the next printing processing.

[Hardware Configuration of Image Forming Apparatus 100]

Figure 13:
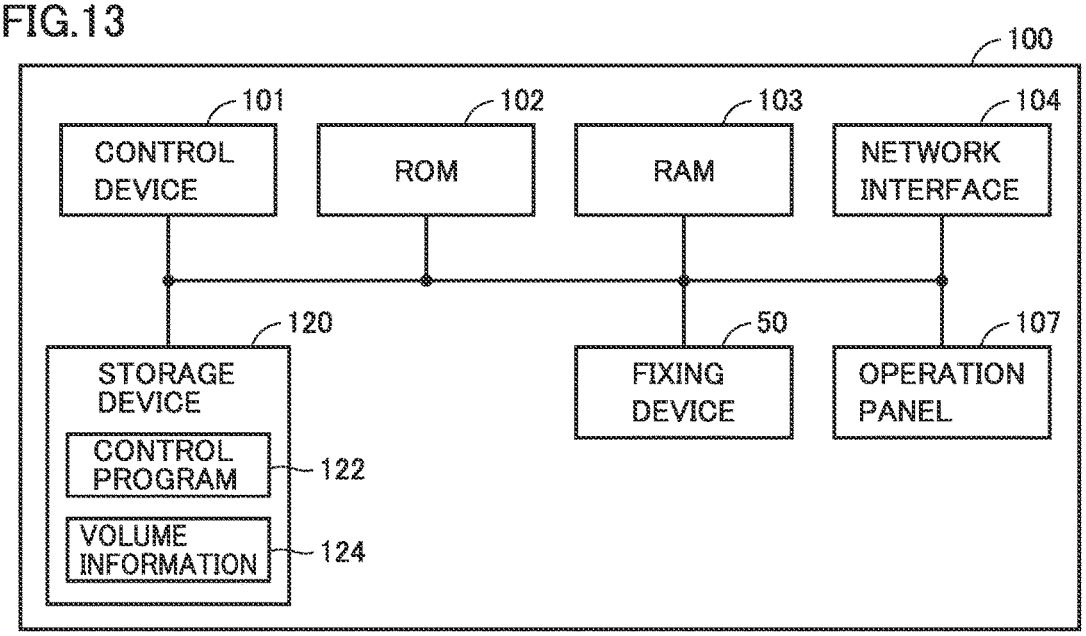
FIG. 13 is a block diagram illustrating a main hardware configuration of the image forming apparatus.

Referring to FIG. 13, an example of a hardware configuration of image forming apparatus 100 will be described below. FIG. 13 is a block diagram illustrating a main hardware configuration of image forming apparatus 100.

As illustrated in FIG. 13, image forming apparatus 100 includes a control device 101, a read only memory (ROM) 102, a random access memory (RAM) 103, a network interface 104, an operation panel 107, and a storage device 120.

For example, control device 101 is constructed with at least one integrated circuit. For example, the integrated circuit is constructed with at least one central processing unit (CPU), at least one application specific integrated circuit (ASIC), at least one field programmable gate array (FPGA), or a combination thereof.

Control device 101 controls action of image forming apparatus 100 by executing various programs such as a control program 122 of the first embodiment. Control device 101 reads control program 122 from storage device 120 to ROM 102 based on reception of a command to execute control program 122. RAM 103 acts as a working memory to temporarily store various pieces of data necessary for the execution of control program 122 therein.

An antenna (not illustrated) or the like is connected to network interface 104. Image forming apparatus 100 exchanges the data with an external communication device through the antenna. For example, the external communication device includes a mobile communication terminal such as a smartphone and a server. Image forming apparatus 100 may be configured to be able to download control program 122 from the server through the antenna.

Operation panel 107 is constructed with a display and a touch panel. The display and the touch panel overlap each other. For example, operation panel 107 receives a printing operation, a scan operation, or the like with respect to image forming apparatus 100.

Storage device 120 is a storage medium such as a hard disk and an external storage device. Storage device 120 stores therein control program 122, volume information 124, and the like (see FIG. 17) of the first embodiment. Storage places of control program 122 and volume information 124 are not limited to storage device 120, but control program 122 and volume information 124 may be stored in a storage area (such as a cache) of control device 101, ROM 102, RAM 103, an external device (such as a server), or the like.

Control program 122 is not provided as a single program, but may be provided by being incorporated in a part of any program. In this case, control processing of the first embodiment is performed in conjunction with any program. Even the program that does not partially include module is also included in control program 122 of the first embodiment. A part or whole of the function provided by control program 122 may be implemented by dedicated hardware. Image forming apparatus 100 may be configured in such a form as what is called cloud service in which at least one server partially performs the processing of control program 122.

[Summary]

As described above, fixing device 50 applies the thermal energy from heater H or electric energy to heat storage material 54 as the external energy after the sheet printing. Therefore, heat storage material 54 changes from the solid phase β to the solid phase λ to store the heat. Fixing device 50 pressurizes heat storage material 54 during the warm-up processing before the sheet printing. Therefore, heat storage material 54 changes from the solid phase λ to the solid phase β to radiate the stored thermal energy. Thus, the thermal energy stored after the sheet printing is used during the warm-up before the sheet printing, which achieves the energy saving. That is, because heat storage material 54 does not use the phase change to a liquid phase for the purpose of the heat storage and heat radiation, it is not necessary to provide the configuration preventing the liquid leakage. Therefore, the configuration of fixing device 50 is simplified.

Second Embodiment

Figure 14:
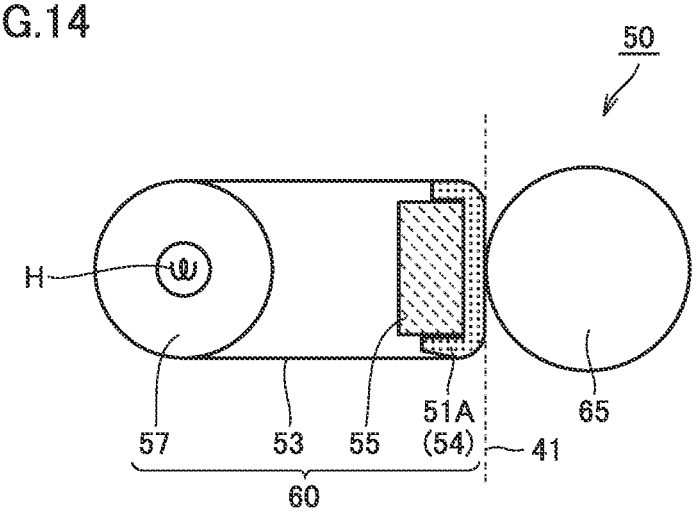
FIG. 14 is a view illustrating an internal structure of a fixing device according to a second embodiment.

Referring to FIG. 14, a fixing device 50 according to a second embodiment will be described below. FIG. 14 is a view illustrating an internal structure of fixing device 50 of the second embodiment.

Fixing device 50 of the first embodiment includes fixing roller 51. On the other hand, fixing device 50 of the second embodiment includes a sliding pad 51A made of heat storage material 54, instead of fixing roller 51. Because other configurations are similar to those of fixing device 50 of the first embodiment, the overlapping description is omitted.

Sliding pad 51A is fixed with a fixation member 55. Heat storage material 54 receives the thermal energy from heater H, and changes from the solid phase β to the solid phase λ to store the heat. When pressurizing roller 65 pressurizes sliding pad 51A, heat storage material 54 changes from the solid phase λ to the solid phase β to radiate the heat.

Third Embodiment

Figure 15:
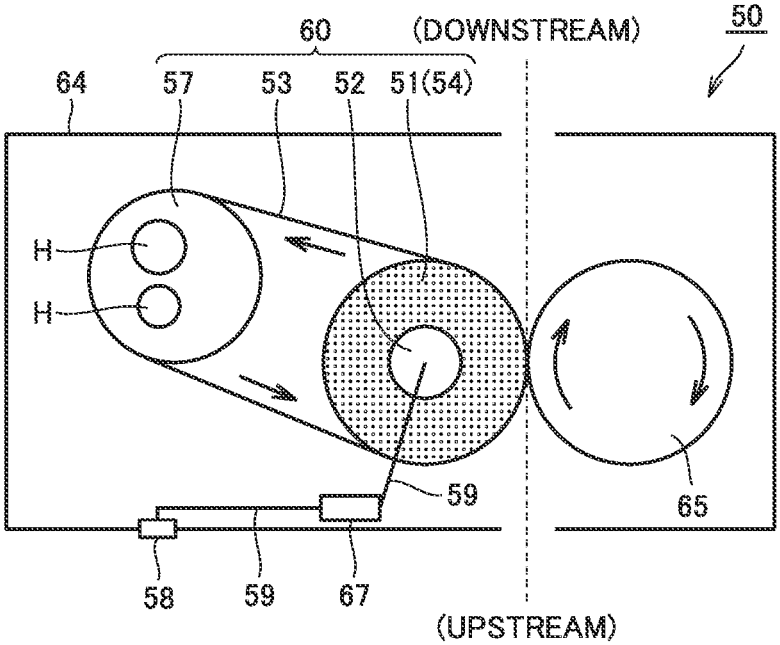
FIG. 15 is a view illustrating an internal structure of a fixing device according to a third embodiment.

Referring to FIG. 15, a fixing device 50 according to a third embodiment will be described below. FIG. 15 is a view illustrating an internal structure of fixing device 50 of the third embodiment.

In fixing device 50 of the first embodiment, thermoelectric element 58 is provided inside fixing belt 53 (see FIG. 5). On the other hand, in fixing device 50 of the third embodiment, thermoelectric element 58 is provided in a housing 64 of fixing device 50. Because other configurations are similar to those of fixing device 50 of the first embodiment, the overlapping description is omitted.

As described above, when the temperature difference is generated between the surfaces of thermoelectric element 58, the potential difference is generated between the surfaces of thermoelectric element 58. In fixing device 50 of the third embodiment, the potential difference is generated in thermoelectric element 58 using the temperature difference between the inside and the outside of fixing device 50. More specifically, thermoelectric element 58 is provided in housing 64 of fixing device 50. One surface of thermoelectric element 58 is located inside housing 64. The other surface of thermoelectric element 58 is located outside housing 64.

Because fixing member 60 is heated during the sheet printing, the temperature at the inside of fixing device 50 is higher than that at the outside of fixing device 50. The potential difference is generated in thermoelectric element 58 by temperature difference. The electric energy obtained from thermoelectric element 58 is stored in a battery 67 connected to thermoelectric element 58. The electric energy stored in battery 67 is supplied to heat storage material 54 in any timing. For example, the electric energy stored in battery 67 is supplied to heat storage material 54 after the sheet printing. Therefore, after the sheet printing, heat storage material 54 changes from the solid phase β to the solid phase λ to store the heat.

In the above configuration, fixing device 50 can store the heat using not only the thermal energy after the sheet printing but also thermal energy generated during the sheet printing. Therefore, fixing device 50 can more efficiently achieve the energy saving.

Fourth Embodiment

[Outline]

In the first embodiment, the setting of fixing device 50 is kept constant irrespective of the phase state of heat storage material 54. On the other hand, the setting of fixing device 50 according to a fourth embodiment is changed according to the phase state of heat storage material 54. Because other configurations are similar to those of fixing device 50 of the first embodiment, the overlapping description is omitted.

[Fixing Device 50]

Figure 16:
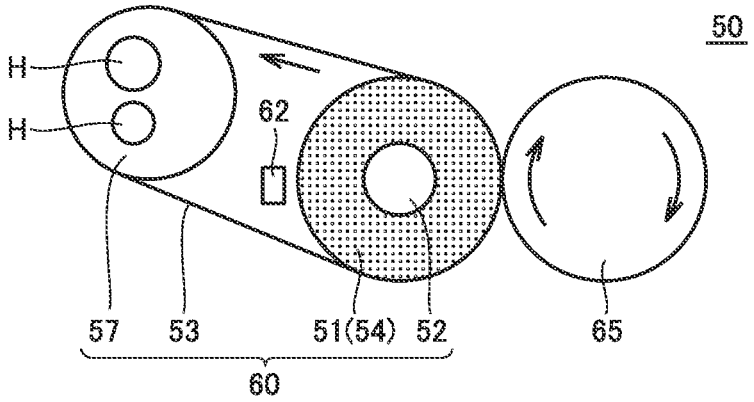
FIG. 16 is a view illustrating an internal structure of a fixing device according to a fourth embodiment.

Referring to FIGS. 16 and 17, fixing device 50 according to the fourth embodiment will be described below. FIG. 16 is a view illustrating an internal structure of fixing device 50 of the fourth embodiment.

As described above, heat storage material 54 changes between the solid phase β and the solid phase λ. Because the crystal structure of the solid phase β is different from the crystal structure of the solid phase λ, a volume of heat storage material 54 changes according to the phase state of heat storage material 54. The fixing condition during the sheet printing changes according to the volume change of heat storage material 54. Examples of the fixing conditions include the contact pressure between fixing member 60 and pressurizing roller 65 and the time during which the currently-conveyed sheet is in contact with the contact portion between fixing member 60 and pressurizing roller 65. Printing quality such as a fixing property and gloss varies when the fixing condition varies. In fixing device 50 of the fourth embodiment, based on the volume change of heat storage material 54 due to the phase change in heat storage material 54, the fixing condition during passage of the sheet through the contact portion between fixing member 60 and pressurizing roller 65 is changed in order to suppress the variation in printing quality.

As illustrated in FIG. 16, fixing device 50 includes a temperature sensor 62 that estimates the volume change of heat storage material 54. Temperature sensor 62 is provided near fixing roller 51 to detect a surface temperature of fixing roller 51. The temperature of fixing roller 51 is correlated with the volume of heat storage material 54. When the temperature of fixing roller 51 increases, heat storage material 54 changes from the solid phase β to the solid phase λ, and the volume of heat storage material 54 increases.

For example, the volume of fixing roller 51 to the phase state of heat storage material 54 is previously prescribed in volume information 124. FIG. 17 is a view illustrating content of volume information 124. For example, the volume of fixing roller 51 is represented by a radius of fixing roller 51 or a distance between fixing roller 51 and pressurizing roller 65 (hereinafter, referred to as an "inter-roller distance").

Volume information 124 is previously prescribed. In the example of FIG. 17, when heat storage material 54 has the solid phase β, fixing roller 51 has a radius of $r_\beta$ and an inter-roller distance of R. When heat storage material 54 has the solid phase λ, fixing roller 51 has a radius of rx and an inter-roller distance of $R-(r_\lambda-r_\beta.)$. Radius $r_\lambda$ is larger than radius $r_\beta$. That is, the volume of heat storage material 54 having the solid phase λ is larger than that of heat storage material 54 having the solid phase β.

Fixing device 50 estimates the phase state of heat storage material 54 based on the temperature detected with temperature sensor 62. In the case where the temperature obtained from temperature sensor 62 is less than or equal to phase transition temperature U2 (see FIG. 10), fixing device 50 determines that heat storage material 54 has the solid phase β. Phase transition temperature U2 is previously set in production or design of fixing device 50. When determining that heat storage material 54 has the solid phase β, fixing device 50 refers to volume information 124 to determine that heat storage material 54 has the radius of rp. On the other hand, in the case where the temperature obtained from temperature sensor 62 is higher than phase transition temperature U2, fixing device 50 determines that heat storage material 54 has the solid phase λ. In this case, fixing device 50 refers to volume information 124 to determine that heat storage material 54 has the radius of rx.

In the example of FIG. 16, fixing device 50 estimates the volume of fixing roller 51 based on the temperature detected with temperature sensor 62. Alternatively, fixing device 50 may estimate the volume of fixing roller 51 based on another index correlated with the volume of fixing roller 51. For example, instead of temperature sensor 62, a distance sensor (not illustrated) is provided near fixing roller 51. The distance sensor detects a distance from the distance sensor to fixing roller 51. In fixing device 50, the distance detected with the distance sensor is used as the index correlated with the volume of fixing roller 51.

In fixing device 50, based on the volume change of fixing roller 51 due to the phase change in heat storage material 54, the fixing condition during passage of the sheet through the contact portion between fixing member 60 and pressurizing roller 65 is changed. In one aspect, the fixing condition includes a pressurization load on the contact portion between fixing member 60 and pressurizing roller 65 when the sheet passes through the contact portion. The contact pressure increases with increasing volume of heat storage material 54. Therefore, fixing device 50 adjusts the pressurization load such that the contact pressure between fixing member 60 and pressurizing roller 65 is kept constant based on the volume change of heat storage material 54. More specifically, fixing device 50 decreases the pressurization load when the volume of heat storage material 54 is larger than or equal to a predetermined volume, and fixing device 50 increases the pressurization load when the volume of heat storage material 54 is smaller than the predetermined volume. Therefore, the contact pressure between fixing member 60 and pressurizing roller 65 is kept constant irrespective of the phase change of heat storage material 54. Resultantly, the variation in printing quality is suppressed.

In another aspect, the fixing condition includes a sheet conveying speed when the sheet passes through the contact portion between fixing member 60 and pressurizing roller 65. The time during which the sheet is in contact with fixing member 60 is lengthened with increasing volume of heat storage material 54. Therefore, fixing device 50 enhances the sheet conveying speed with increasing volume of heat storage material 54. In other words, fixing device 50 reduces the sheet conveying speed with decreasing volume of heat storage material 54. Therefore, the time during which the sheet is in contact with fixing member 60 is kept constant irrespective of the phase change of heat storage material 54. Resultantly, the variation in printing quality is suppressed.

In the above description, fixing device 50 changes one of the contact pressure and the sheet conveying speed. Alternatively, fixing device 50 may change the contact pressure and the sheet conveying speed. That is, fixing device 50 changes at least one of the contact pressure and the sheet conveying speed according to the volume of heat storage material 54.

Although the embodiments of the present invention have been described, it is to be understood that, in all respects, the present disclosed embodiments are illustrative and not restrictive. The scope of the present invention is to be determined solely by the following claims, and includes the meanings equivalent to the claims and all the changes within the claims.

What is claimed is:

1. A fixing device that fixes toner to a sheet by heat, said fixing device comprising:

a fixing member;

a pressurizing member provided in contact with said fixing member and configured to pressurize said sheet, which passes through a contact portion between said fixing member and said pressurizing member, against said fixing member; and a heating unit configured to heat at least one of said fixing member and said pressurizing member to provide heat to said sheet passing through said contact portion, wherein at least one of said fixing member and said pressurizing member includes a heat storage material, said heat storage material has:

a property that changes from a first solid phase to a second solid phase by application of external energy, said second solid phase having internal energy higher than that of said first solid phase, and a property that changes from said second solid phase to said first solid phase by application of pressure and radiates heat during the phase change, said external energy applied for causing said heat storage material to change from said first solid phase to said second solid phase includes thermal energy of at least one of said fixing member and said pressurizing member, that is heated with said heating unit, and said pressure applied for causing said heat storage material to change from said second solid phase to said first solid phase includes a contact pressure between said fixing member and said pressurizing member.

2. The fixing device according to claim 1, wherein said fixing device does not cause said heat storage material to change from said first solid phase to said second solid phase during printing of said sheet.

3. The fixing device according to claim 1, wherein said fixing device causes said heat storage material to change from said first solid phase to said second solid phase after printing of said sheet.

4. The fixing device according to claim 3, wherein said external energy applied for causing the heat storage material to change from said first solid phase to said second solid phase includes residual heat of at least one of said fixing member and said pressurizing member after printing of said sheet.

5. The fixing device according to claim 1, wherein said fixing device causes said heat storage material to change from said second solid phase to said first solid phase before printing of said sheet.

6. The fixing device according to claim 5, wherein said heating unit performs, before printing of said sheet, warm-up to increase a temperature of said fixing member up to a first temperature at which said toner is able to be fixed to said sheet, and said fixing device causes said heat storage material to change from said second solid phase to said first solid phase during said warm-up.

7. The fixing device according to claim 6, wherein said heat storage material has a property that changes from said first solid phase to said second solid phase at a second temperature or higher, and said second temperature is higher than said first temperature.

8. The fixing device according to claim 1, wherein said fixing device causes said heat storage material to change from said second solid phase to said first solid phase during printing of said sheet.

9. The fixing device according to claim 1, wherein said fixing device sets said contact pressure before printing of said sheet to be higher than said contact pressure during and after printing of said sheet.

10. The fixing device according to claim 1, wherein said heat storage material is used in at least one of said fixing member and said pressurizing member, said fixing member and said pressurizing member constituting said contact portion.

11. The fixing device according to claim 1, wherein said external energy applied for causing the heat storage material to change from said first solid phase to said second solid phase includes electric energy.

12. The fixing device according to claim 1, further comprising a thermoelectric element electrically connected to said heat storage material, wherein said thermoelectric element converts said thermal energy into electric energy, and supplies the electric energy to said heat storage material as said external energy.

13. The fixing device according to claim 1, wherein said fixing device changes a fixing condition during passage of said sheet through said contact portion, based on a volume change of said heat storage material due to the phase change of said heat storage material.

14. The fixing device according to claim 13, wherein said fixing condition includes a pressurization load on said contact portion during passage of said sheet through said contact portion, and said fixing device adjusts said pressurization load such that the contact pressure is kept constant in said contact portion, based on the volume change of said heat storage material.

15. The fixing device according to claim 13, wherein said fixing condition includes a conveyance speed of said sheet during passage of said sheet through said contact portion, and said fixing device enhances said conveyance speed of said sheet with increasing volume of said heat storage material.

16. An image forming apparatus comprising the fixing device according to claim 1.

17. A method for controlling a fixing device that fixes toner to a sheet by heat, said fixing device including:

a fixing member; and a pressurizing member provided in contact with said fixing member and configured to pressurize said sheet, which passes through a contact portion between said fixing member and said pressurizing member, against said fixing member, at least one of said fixing member and said pressurizing member including a heat storage material, said heat storage material having:

a property that changes from a first solid phase to a second solid phase by application of external energy, said second solid phase having internal energy higher than that of said first solid phase, and a property that changes from said second solid phase to said first solid phase by application of pressure and radiates heat during the phase change, said method comprising the steps of:

heating at least one of said fixing member and said pressurizing member;

applying thermal energy of at least one of said fixing member and said pressurizing member to said heat storage material as said external energy, that is heated in said heating, in order to cause said heat storage material to change from said first solid phase to said second solid phase; and applying a contact pressure between said fixing member and said pressurizing member to said heat storage material as said pressure, in order to cause said heat storage material to change from said second solid phase to said first solid phase.

18. A computer-readable recording medium in which a control program for a fixing device that fixes toner to a sheet by heat is stored, said fixing device including:

a fixing member; and a pressurizing member provided in contact with said fixing member and configured to pressurize said sheet, which passes through a contact portion between said fixing member and said pressurizing member, against said fixing member, at least one of said fixing member and said pressurizing member including a heat storage material, said heat storage material having:

a property that changes from a first solid phase to a second solid phase by application of external energy, said second solid phase having internal energy higher than that of said first solid phase, and a property that changes from said second solid phase to said first solid phase by application of pressure and radiates heat during the phase change, said control program causing said fixing device to perform the steps of:

heating at least one of said fixing member and said pressurizing member;

applying thermal energy of at least one of said fixing member and said pressurizing member to said heat storage material as said external energy, that is heated in said heating, in order to cause said heat storage material to change from said first solid phase to said second solid phase; and applying a contact pressure between said fixing member and said pressurizing member to said heat storage material as said pressure, in order to cause said heat storage material to change from said second solid phase to said first solid phase.

19. The fixing device according to claim 1, wherein said heat storage material changes from said second solid phase to said first solid phase by increasing said contact pressure between said fixing member and said pressurizing member.

20. The method according to claim 17, wherein said heat storage material changes from said second solid phase to said first solid phase by increasing said contact pressure between said fixing member and said pressurizing member.

21. The computer-readable recording medium according to claim 18, wherein said heat storage material changes from said second solid phase to said first solid phase by increasing said contact pressure between said fixing member and said pressurizing member.

22. The fixing device according to claim 1, further comprising a heating unit and a fixing belt in contact with the heating unit, wherein the fixing belt is configured to transfer heat from the heating unit to at least one of said fixing member and said pressurizing member to provide heat to said sheet passing through said contact portion.

23. The method according to claim 17, wherein the fixing device further comprises a heating unit and a fixing belt in contact with the heating unit, and wherein the fixing belt is configured to transfer heat from the heating unit to at least one of said fixing member and said pressurizing member to provide heat to said sheet passing through said contact portion.

24. The computer-readable recording medium according to claim 18, wherein the fixing device further comprises a heating unit and a fixing belt in contact with the heating unit, and wherein the fixing belt is configured to transfer heat from the heating unit to at least one of said fixing member and said pressurizing member to provide heat to said sheet passing through said contact portion.

* * * * *